United States Patent [19]

Feighery

[11] 4,002,308

[45] Jan. 11, 1977

[54] CARPET ROLL-UP MECHANISM

[75] Inventor: James M. Feighery, Dalton, Ga.

[73] Assignee: Tex Del Inc., Dalton, Ga.

[22] Filed: Aug. 5, 1975

[21] Appl. No.: 601,980

[52] U.S. Cl. ..... 242/66; 242/55; 242/56 R; 242/68.7

[51] Int. Cl.[2] ..... B65H 17/12; B65H 19/26

[58] Field of Search ..... 242/55, 56 R, 66, 67.1 R, 242/DIG. 3, 68.7; 72/146, 148

[56] References Cited

UNITED STATES PATENTS

| | | | |
|---|---|---|---|
| 3,537,662 | 11/1970 | Keesling et al. | 242/56 R |
| 3,841,578 | 10/1974 | Dorfel | 242/56 R |
| 3,918,654 | 11/1975 | Okubo et al. | 242/56 R |

FOREIGN PATENTS OR APPLICATIONS

| | | | |
|---|---|---|---|
| 472,844 | 3/1929 | Germany | 242/66 |

*Primary Examiner*—George F. Mautz
*Attorney, Agent, or Firm*—B. P. Fishburne, Jr.

[57] ABSTRACT

A simplified and versatile carpet roll-up mechanism allows customer carpet orders to be rolled pile in or pile out after cutting to proper length in a combination machine for unrolling carpet from a supply roll, measuring and cutting transversely of the web. The improved roll-up mechanism allows four cooperating rolls to manipulate the carpet web without employing coacting mechanical bars or fingers customarily required to initiate the rolling operation. Following completion of the roll, the roll is cleanly ejected from the roll-up mechanism. The mechanism is under control of a uniquely arranged system of power cylinders.

5 Claims, 10 Drawing Figures

CARPET ROLL-UP MECHANISM

BACKGROUND OF THE INVENTION

Machines are known in the prior art for unrolling specified lengths of carpet from a large supply roll, accurately measuring the lengths to a customer specifications, cutting the measured lengths from the main carpet web, and rolling up the severed lengths of carpet for delivery to the customer.

The present invention is concerned in general with improvements in combination machines for processing cut carpet orders in the manner above-described, and more particularly relates to an improved and simplified carpet web roll-up mechanism which allows cut carpet sections of various lengths to be rolled up after measuring and cutting in a most efficient manner.

According to the present invention, the lengths of carpet to be rolled up are received in the improved roll-up mechanism while the latter is in a expanded or open position following ejection of a previously rolled order. A system of four cooperating rolls, acting alone and without the usual mechanical bars or fingers employed to start the rolling operation, act directly on the leading end of the carpet section to roll up the same selectively with the pile side in or out, as determined by the direction of rotation of the coacting rolls. The system is direct-acting and substantially foolproof. A minimum number of parts are utilized, and the construction of the mechanism is very rugged and durable. Three coacting extensible and retractable power cylinders coupled with pivoted support links for the rolls at the opposite ends of the rolls produce the required closing and opening of the roll array relative to the carpet being rolled up by the mechanism. One pair of power cylinders cooperates particularly in the ejection of the completed carpet roll. Both the power cylinder means and the power drive system for turning the several rolls on their rotational axes are characterized by simplicity and compactness.

Other features and advantages of the invention will become apparent during the course of the following description.

BRIEF DESCRIPTION OF DRAWING FIGURES

DETAILED DESCRIPTION

Figure 1:
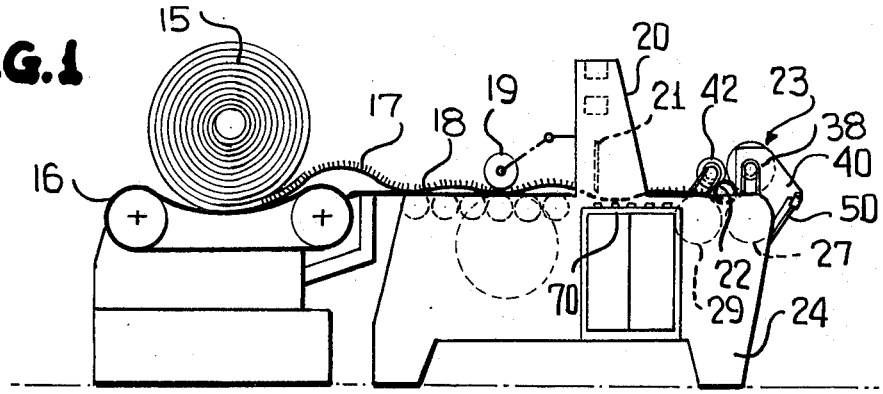
FIG. 1 is a partly schematic side elevational view of a combination carpet unrolling, measuring, cutting and re-rolling machine having the present invention as a feature thereof.

Referring to the drawings in detail, wherein like numerals designate like parts, attention is directed first to FIG. 1 showing the environment in which the present invention is employed. FIG. 1 illustrates the combination apparatus in which a large roll of carpet 15 delivered from a storage magazine, not shown, is received by a conventional unrolled cradle 16 from which a web of carpet 17 is unwound from the roll 15 and passes to a feed table 18 having a linear measurement device 19 associated therewith so that the length of the web 17 may be accurately measured. From the measuring means 19, the carpet web advances to a cutting station 20 where the web is severed transversely by a cross cutter 21. The measured and severed carpet section 22 is received at its leading end by an automatic roll-up mechanism 23 forming the particular subject matter of the present invention, and whose construction and operation will now be fully described.

The invention proper is illustrated in detail in FIGS. 2 through 10 and comprises spaced supporting frame sides 24 which may be integral with the framework of the feed table 18 and cut-off station 20, as shown in FIG. 1. The frame sides 24 are formed by sturdy plates, whereby they may firmly support the end bearings 25 and 26 of a first fixed axis roll 27 which extends horizontally and transversely of the mechanism. The roll 27 has a shaft 28 rigid therewith and this shaft is journaled within the aforementioned bearings 25 and 26. Similarly, a closely adjacent fixed axis roll 29 of the same diameter as the roll 27 is arranged immediately rearwardly thereof, and at the same elevation as the roll 27. This second fixed axis roll has a horizontal transverse shaft 30 rigid therewith and supported in bearings 31 mounted on the frame sides 24. The frame sides 24 additionally support the bearings 32 of a fixed axis cross shaft 33, on which a sleeve 34 is rockably mounted, said sleeve provided near its ends with depending rigid crank arms 35 for a purpose which will be described fully. A pair of transverse horizontal stub shafts 36 are also journaled in bearings 37 on the frame sides 24, FIG. 8, and the several shafts 28, 30, 33 and 36 have parallel transverse axes.

A movable or swing axis axis roll 38, preferably of the same diameter as the two fixed axis rolls 27 and 29, is arranged immediately above the roll 27 for swinging movement around the axis of the latter as defined by its shaft 28. The movable roll 38 has a shaft 39 whose ends are journaled on a pair of swinging frames or links 40 constituted by a pair of plates. The swinging frames 40 are rigidly joined by a cross beam 41 so that they are tied together for movement in unison. Corresponding ends of the frames 40 are pivotally mounted on the shaft 28 of fixed axis roll 27.

Figure 10:
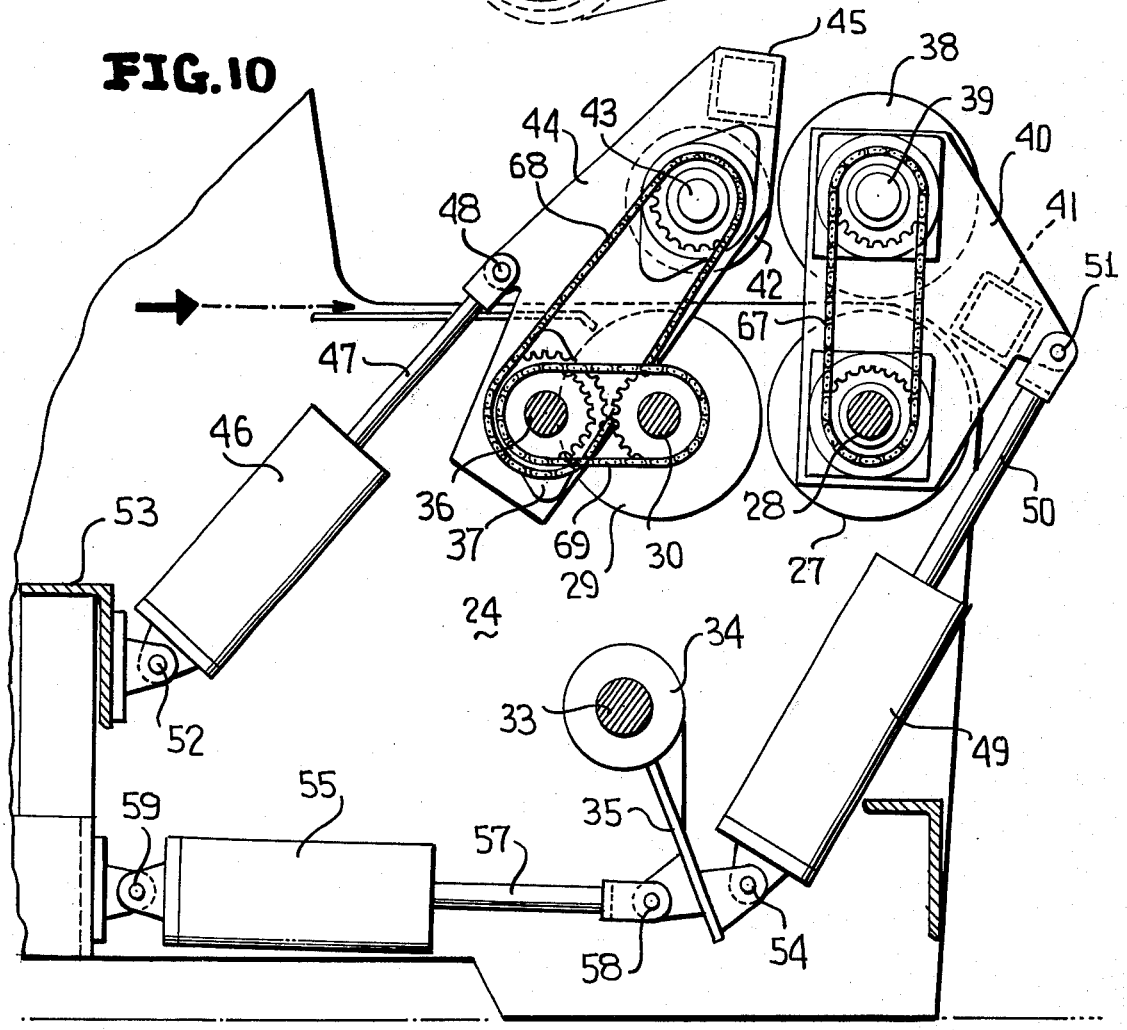
FIG. 10 is a fragmentary side elevation of the mechanism as shown in FIG. 2, partly in section.
Figure 8:
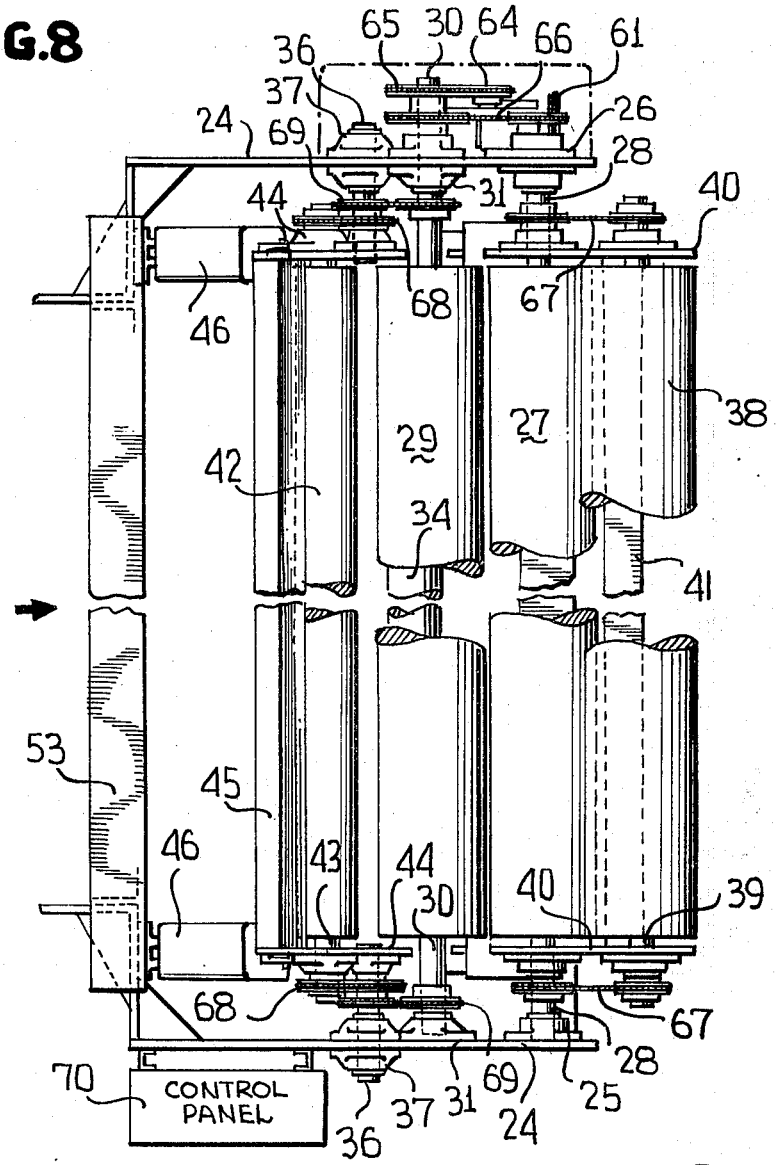
FIG. 8 is a plan view of the mechanism as depicted in FIG. 7.
Figure 9:
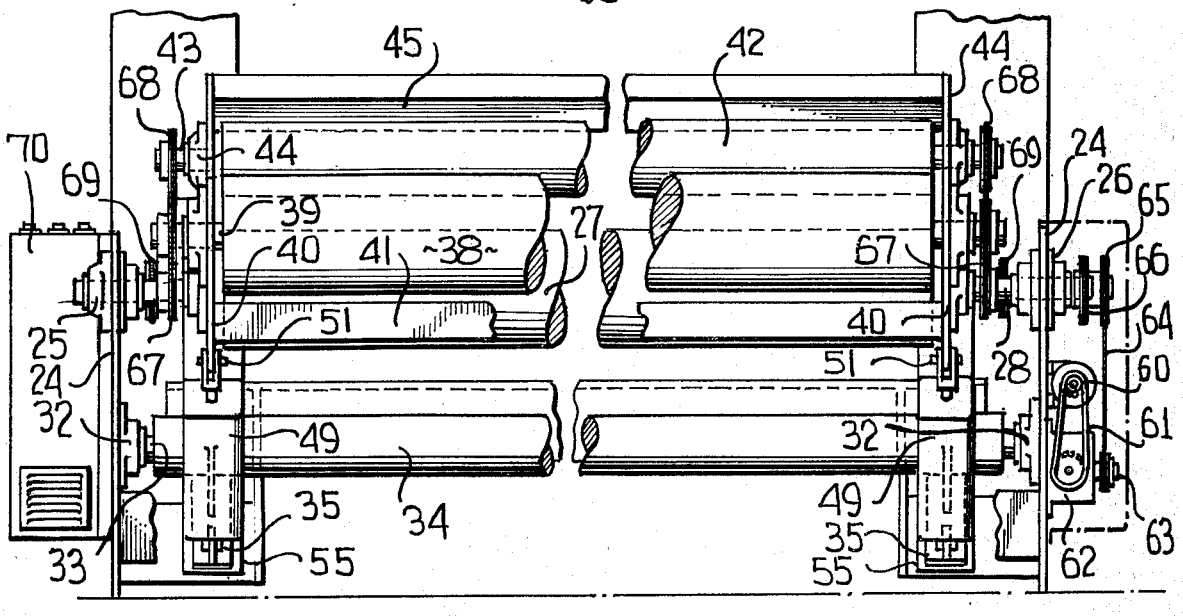
FIG. 9 is a front elevational view of the mechanism as depicted in FIG. 7.

In a similar manner, a movable or swinging axis roll 42 of somewhat smaller diameter than the three rolls 27, 29 and 38 is mounted above the fixed axis roll 29 and rearwardly of movable roll 38, FIG. 10. A shaft 43 of the roll 42 is supported and journaled near its ends by vertically swingable frames 44, or plates, similar to the frames 40. These swingable frames 44 are rigidly joined at their tops by a transverse horizontal beam 45 parallel to the beam 41. The frames 44 have their lower end portions pivotally mounted on the two stub shafts 36 so that they may swing in vertical planes about the axes of these shafts.

To achieve a desired swinging movement of the roll 42 relative to the other rolls of the system, a first pair of power cylinders 46, such as pneumatic cylinders, have their rods 47 attached at 48 to extensions of the frames 44. Similarly, to effect the desired movement of the roll 38 relative to the other rolls, a second pair of power cylinders 49 have their rods 50 attached as at 51 to extensions of the swingable frames 40. The bases of cylinders 46 are attached at 52 to a rigid transverse fixed beam 53 of the apparatus main frame including frame sides 24. Similarly, the bases of cylinders 49 are attached at 54 to lugs formed on the forward sides of crank arms 35.

Figure 3:
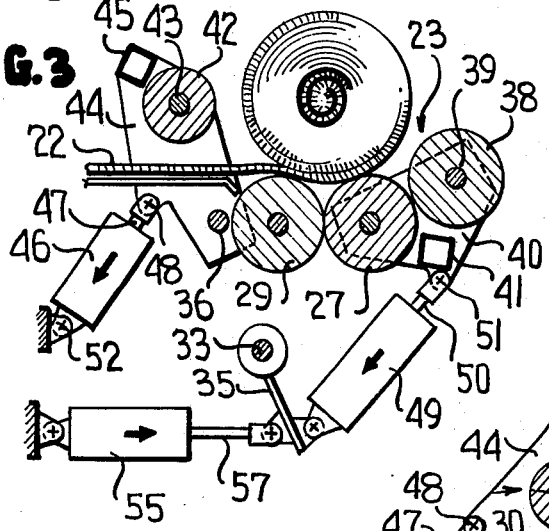
FIG. 3 is a similar view of the mechanism in a second operating position forming a cradle continuing to roll the carpet.
Figure 4:
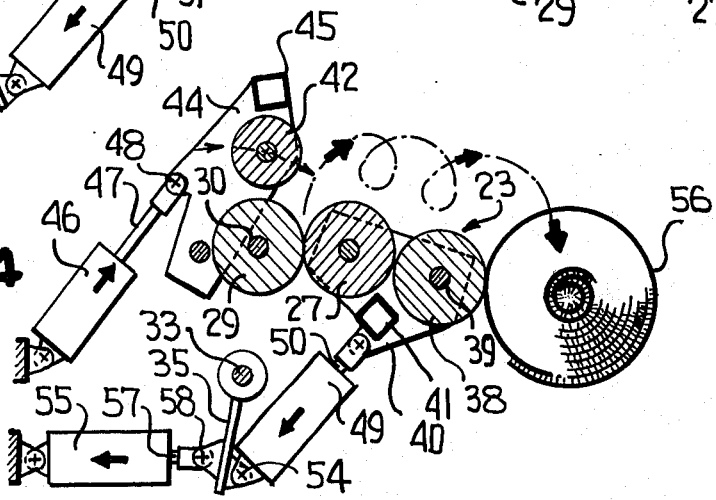
FIG. 4 is a similar view showing a third operating position of the mechanism where the completely rolled cut carpet order is ejected from the mechanism.

A third pair of power cylinders 55 are provided in the roll-up mechanism and their unique function in conjunction with the cylinders 49 particularly in the ejection of a carpet roll 56, as shown in FIG. 4, will be further described. The rods 57 of cylinders 55 are connected at 58 to lugs on the rearward sides of crank arms 35. The bases of the cylinders 55 are secured at 59 to a solid structural member of the support frame for the apparatus. It should now be apparent, by referring to FIGS. 2, 3 and 4, that the combined actions of the cylinders 46, 49 and 55 cause the roll-up mechanism 23 to move at proper times from the fully contracted or closed positon of FIG. 2 where the rolling of the carpet section 22 is initiated to the intermediate cradle-like position of FIG. 3 where the carpet roll is growing as it continues to be rolled up by the mechanism, and finally to the fully expanded or carpet roll ejecting position of FIG. 4 where the completely rolled up carpet section 56 is forced from the mechanism.

Figure 2:
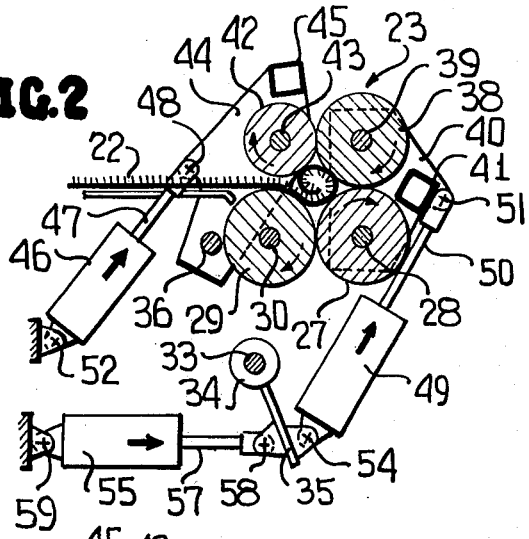
FIG. 2 is a fragmentary vertical cross section showing the carpet roll-up mechanism of the present invention in a first operating position to begin the formation of a carpet roll.
Figure 5:
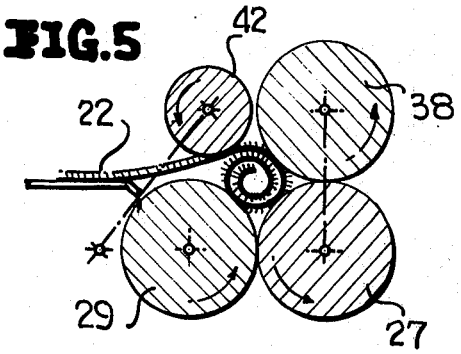
FIG. 5 is a partly schematic view, similar to FIG. 2, showing the roll-up mechanism driven in an opposite direction for rolling carpet with the pile side outermost.
Figure 6:
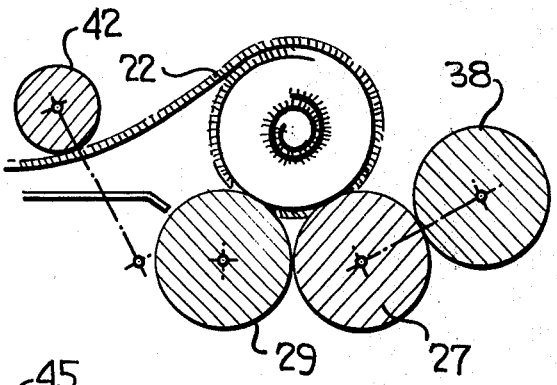
FIG. 6 is a view similar to FIG. 3 showing the continued rolling of carpet with the pile side outermost.

In order to achieve the desired rolling up of the cut carpet section 22 by the mechanism with the pile face inwardly, FIGS. 2, 3 and 4, or with the pile face outwardly, FIGS. 5 and 6, it is merely necessary to drive the four rolls 27, 29, 38 and 42 in unison in one direction or in the opposite direction. In FIGS. 2 and 3, for example, the four rolls are driven clockwise in unison to achieve the desired rolling of the carpet web with the pile face innermost. In FIGS. 5 and 6, the same rolls are driven counterclockwise in unison to roll up the carpet with the pile face outermost. This unique capability of the same roll-up mechanism to roll the cut carpet web in either of two modes is achieved by a simple power drive mechanism for the several rolls, now to be described.

Figure 7:
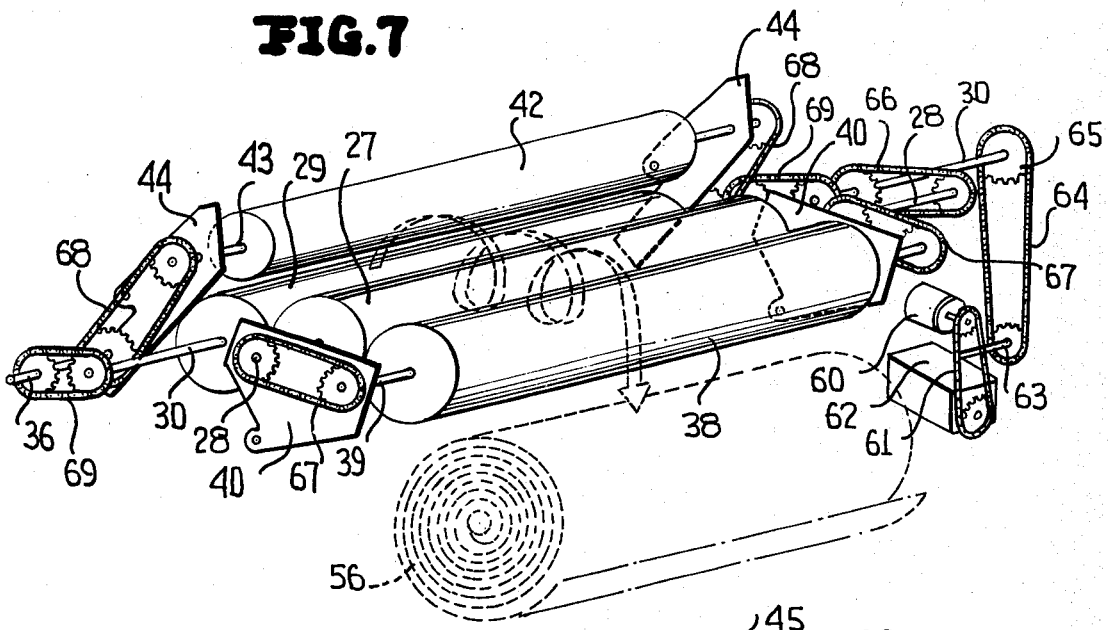
FIG. 7 is a schematic perspective view of the carpet roll-up mechanism and power drive means in the eject position.

A suitable reversible drive motor 60 mounted on one side of the apparatus, FIG. 7, is operatively connected through gearing 61 wit the input shaft of a speed reducer 62, whose output shaft 63 drives additional gearing 64 coupled with a sprocket gear 65 on the shaft 30 of roll 29. Additional gearing 66 drivingly interconnects the two shafts 30 and 28 of the fixed axis rolls 29 and 27.

On the opposite side of the apparatus, FIGS. 7 and 10, the shafts 28 and 39 are drivingly interconnected by further gearing 67 which gearing swings bodily with the frames 40 under influence of power cylinders 49 between the two positions shown in FIGS. 7 and 10. The gearing 67 is provided on both sides of the mechanism as clearly appears in FIGS. 7 and 8. Similarly, the shafts 36 and 43 are drivingly interconnected by gearing 68 at both sides of the mechanism and the shafts 36 derive their rotational power from further gearing 69 on both sides of the mechanism driven from the shaft 30 of roll 29. The gearing 68 is adapted to swing vertically with frames 44 around the axes of stub shafts 36 which stub shafts are coaxially arranged. Regardless of the angular positions of the swingable frames 40 and 44 under influence of the associated extensible and retractable power cylinders, the four rolls of the carpet roll-up system continue to be power driven in the same direction in unison by the single motor 60. By merely reversing the direction of driving by this motor, the mechanism converts from the pile side in carpet roll-up mode shown in FIGS. 2 and 3 to the pile side out roll-up mode of FIGS. 5 and 6. The finished carpet roll ejection operation remains unchanged in either situation, as depicted in FIGS. 4 and 7.

A control panel 70 for the mechanism, equipped with push buttons or the like, is provided on the exterior of one frame side 24. An operator may thereby control the starting, stopping and reversing of the drive motor 60 for the four roll mechanism and may also control the operations of the power cylinders 46, 49 and 55 in properly timed sequence. Through the control panel or console, these operations can be cycled automatically on a predetermined properly timed basis and the electrical controls necessary for accomplishing this are fully conventional and need not be descibed in detail.

In a brief summary of the operation, following the unwinding, measuring and cutting of the web 17 drawn from the carpet supply roll 15, the leading end of the cut section 22 of carpet with its pile facing upwardly enters the roll-up mechanism 23 after the ejection of the preceding carpet roll 56. With the four rolls turning in unison and in the same direction, as described, the mechanism is returned to the fully contracted roll starting position of FIG. 2 or FIG. 5 by extension of the rods 50 and 47 of cylinder pairs 49 and 46 and also by extension of the rods 57 of cylinders 55. Depending upon the direction of rotation of the four rolls, the carpet section 22 will begin to be rolled up with its pile face inwardly or outwardly, as described.

After development of a few turns of rolled carpet with the mechanism contracted as in FIG. 2, the mechanism will expand to the cradling position shown in FIGS. 3 and 6 where the developing roll of carpet is resting on the two fixed axis rolls 27 and 29 which continue to be power driven. This results in the continued development of the carpet roll and the two inactive rolls 42 and 38 are now in a guard position to prevent displacement of the carpet roll from the mechanism. The mechanism assumes the cradling position shown in FIGS. 3 and 6 by the contraction of the rods 50 and 47. The rods 57 remain extended. The crank arms 35 are solidly held by the rods 57 and form a solid base for power cylinders 49 during the transition of the roll-up mechanism from its positions shown in FIGS. 2 and 3.

Upon completion of the carpet roll in the mechanism while in the cradling position, FIGS. 3 and 6, the mechanism moves either automatically or under operator control to the eject position shown in FIGS. 4 and 7. In such position, the roll 38 moves downwardly to a position slightly blow the level of rolls 27 and 29 and the roll 42 moves forwardly to a position directly above the roll 29 and, in so doing, forces the carpet roll 56 from its seat on the two fixed axis rolls 27 and 29 from which the carpet roll will be fully ejected by gravity from the mechanism as indicated by the movement arrows in FIGS. 4 and 7. In assuming this position, the rods 47 of cylinders 46 are extended while the rods 57 of cylinders 55 are retracted to thereby swing the crank arms 35 clockwise about the support shaft 33. The rods 50 of cylinders 49 remain fully retracted. Therefore, the extra required degree of downward swinging movement of the frames 40 in the ejection operation is achieved by use of the cylinders 55. At other times, the extended rods 57 of cylinders 55 solidly position crank arms 35 which in turn solidly support the cylinders 49. The arrangement is compact and allows the use of three sets only of short stroke cylinder-piston units. Without this particular array of power cylinders, the movement cycle of the system between the extremes of FIGS. 2 and 4 would be much more difficult and costly to achieve. Also, the power driven chain and sprocket gearing previously described is compact and simplified and uniquely arranged to maintain the driving of all rolls throughout the range of angular positions of the frames 40 and 44.

The versatility, economy and basic simplicity of the mechanism should now be appreciated by anyone skilled in this art.

It is to be understood that the form of the invention herewith shown and described is to be taken as a preferred example of the same, and that various changes in the shape, size and arrangement of parts may be restored to, without departing from the spirit of the invention or scope of the subjoined claims.

I claim:

1. A carpet roll-up mechanism comprising a support frame, a pair of fixed axis parallel rolls journaled on the support frame in side-by-side close relationship, a pair of swing axis rolls which are parallel to each other and parallel to the fixed axis rolls and bodily movable on arcuate paths relative to the fixed axis rolls, end carrier frames for the swing axis rolls including interconnecting beams, the swing axis rolls being journaled on said end carrier frames, the end carrier frames for one swing axis roll rockably mounted on the shaft of one fixed axis roll, fixed axis shaft means on said support frame spaced from and parallel to the other fixed axis roll and rockably supporting the end carrier frames of the other swing axis roll, reversible power drive means coupled with all of said rolls for turning them in unison in one direction on their parallel axes, first extensible and retractable power cylinder means interconnecting said support frame and end carrier frames for the last-named swing axis roll, second extensible and retractable power cylinder means connected with the end carrier frames of the first-named swing axis roll, intermediate fixed axis rockable support means on the support frame and connected with said second power cylinder means and supporting one end thereof, and third extensible and retractable power cylinder means interconnecting said support frame and intermediate fixed axis rockable support means.

2. A carpet roll-up mechanism as defined in claim 1, wherein said fixed axis rolls are substantially of the same diameter, one swing axis roll having substantially the same diameter as said fixed axis rolls and the other swing axis roll having a substantially smaller diameter than the fixed axis rolls.

3. A carpet roll-up mechanism as defined in claim 2, and the smaller diameter swing axis roll being said other swing axis roll whose end carrier frames are rockably supported on said fixed axis shaft means.

4. A carpet roll-up mechanism as defined in claim 1, and said intermediate fixed axis rockable support means comprising a rocker shaft on said support frame parallel to the axes of all of said rolls, and end crank arms on the rocker shaft connected with the second and third extensible and retractable power cylinder means.

5. A carpet roll-up mechanism as defined in claim 4, and said end crank arms pivotally connected with the cylinder ends of said second extensible and retractable power cylinder means and with the rod ends of said third extensible and retractable power cylinder means.

* * * * *